US006485210B2

(12) United States Patent
Choi

(10) Patent No.: US 6,485,210 B2
(45) Date of Patent: Nov. 26, 2002

(54) CLAMSHELL DEVICE FOR PRINTERS

(75) Inventor: Hae Yong Choi, Kyungki-Do (KR)

(73) Assignee: Samsung Electro-Mechanics Co., Ltd., Suwon-shi (KR)

( * ) Notice: Subject to any disclaimer, the term of this patent is extended or adjusted under 35 U.S.C. 154(b) by 50 days.

(21) Appl. No.: 09/841,345

(22) Filed: Apr. 24, 2001

(65) Prior Publication Data

US 2002/0081136 A1 Jun. 27, 2002

(30) Foreign Application Priority Data

Dec. 21, 2000 (KR) ..... 2000-79935

(51) Int. Cl.[7] ..... B41J 29/02
(52) U.S. Cl. ..... 400/691; 400/663
(58) Field of Search ..... 400/691, 693, 400/663; 347/108, 170, 222, 263

(56) References Cited

U.S. PATENT DOCUMENTS 4,860,031 A * 8/1989 Lejcek ..... 346/136
5,201,588 A * 4/1993 Sakai et al. ..... 346/136
5,230,576 A * 7/1993 Sone ..... 400/613
6,345,782 B1 * 2/2002 Nakayama et al. ..... 242/564.4

* cited by examiner

*Primary Examiner*—Daniel J. Colilla
(74) *Attorney, Agent, or Firm*—Ladas & Parry

(57) ABSTRACT

A clamshell device for printers is disclosed. This clamshell device has a main body including a paper roll seat opening used for installing a paper roll therein, with an inclined guide surface formed at the upper edge of each sideall defining the paper roll seat opening. A roller frame is hinged to the main body, and is used for selectively closing the paper roll seat opening. This roller frame has a rubber roller coming into compression contact with a holding roller of the main body so as to compress paper passing through the nip of the two rollers. A locking post is movably set within two longitudinal slits of the roller frame at opposite ends thereof, and is movable along the guide surfaces of the main body while being changed in its position within the longitudinal slits during a rotation of the roller frame relative to the main body.

4 Claims, 2 Drawing Sheets

CLAMSHELL DEVICE FOR PRINTERS

BACKGROUND OF THE INVENTION

1. Field of the Invention

The present invention relates to a device used in printers for compressing paper using clamshell-type during a printing process and, more particularly, to a clamshell device for printers having a simple construction and accomplishing the recent trend of compactness, lightness, smallness and thinness of its parts, thus being preferably usable in compact printers, the clamshell device being also designed to improve work efficiency during its fabrication and effectively produced through mass production.

2. Description of the Prior Art

FIG. 1 is a view showing a conventional clamshell device for printers. As shown in the drawing, the conventional clamshell device comprises a cover 11, which is hinged to a main body (not shown) at one end thereof so as to be openable. A rubber roller 14 mounted to the roller frame 12, which is hinged to the cover 11, rotate itself and compresses the paper to be fed to a printer head while maintaining desired tension of the paper during a printing process. A sliding frame 13 hinged to the main body use the elastic force of spring 13', which is normally connected to the main body, so as to support the roller frame 12. A locking member 16 is hinged to the end of the cover 11, and is selectively caught by a stopper 17 of the main body, thus limiting a rotation of the cover 11. A holding roller 15 is mounted to the main body and comes into close contact with the rubber roller 14 so as to support the paper, which is moving into the printer head (not shown) during a printing process of the printer.

In the conventional clamshell device, the rubber roller 14 and the holding roller 15 are completely contact each other during a printing process, thus give a compressing force to the paper passing through the nip between the two rollers.

When the cover 11 is rotated in a cover closing direction as shown by the arrow in FIG. 1, the roller frame 12 hinged to the cover 11 is also rotated in the same direction. The rubber roller 14, mounted to the end of the roller frame 12, is brought into compression contact with the holding roller 15 of the main body, thus compressing the paper fed to the printer head of the printer. Therefore, the paper is fed to the printer head under sufficient tension during a printing process.

In order to maintain the closed position of the cover 11, it is necessary for the stopper 17 to stably catch the locking member 16 provided at the end of the cover 11. When the stopper 17 fails to catch the locking member 16 during such a cover closing action, the roller frame 12 is undesirably rotated clockwise since the spring 13' normally applies the clockwise moment to the sliding frame 13. In such a case, it is almost impossible to maintain the compression contact of the rubber roller 14 with the holding roller 15. When the rubber roller 14 fails to come into compression contact with the holding roller 15 as described above, the two rollers 14 and 15 cannot compress the paper and fail to smoothly feed the paper to the printer head of the printer.

This means that the compression force, applied to the paper during an operation of the clamshell device for printers, is accomplished by the engagement of the locking member 16 of the cover 11 with the stopper 17 of the main body. In addition, the spring 13' applies elastic force to the sliding frame 13 so as to damp any impact generated in the clamshell device during a cover opening or closing action.

However, the conventional clamshell device for printers is problematic in that for making complete compression contact between the rubber roller and the holding roller, it is necessary a locking structure additionally. Other problems of the conventional clamshell device reside in that the device does not have any automatic tilting means, and that it has a complex construction, in addition to an excessive number of parts. Furthermore, the parts of the conventional clamshell device for printers are large in size, and so the conventional clamshell device cannot be usable in compact and small-sized printers.

SUMMARY OF THE INVENTION

The object of the present invention is to provide a clamshell device for printers, which has a simple construction and accomplishes the recent trend of compactness, lightness, smallness and thinness of its parts, thus improving work efficiency during assemblage and being easily produced in commercial quantities.

In order to accomplish the above object, the present invention provides a clamshell device for printers, comprising: a main body including a paper roll seat opening used for installing a paper roll therein, with a guide surface, which is formed at the upper edge of each sidewall, inclined at an angle of inclination; a roller frame hinged to the main body and closing the paper roll seat opening, the roller frame having a holding roller coming into compression contact with a rubber roller of the main body so as to give compression force to paper passing through the nip of the rubber and holding rollers; a locking post movably set within two longitudinal slits of the roller frame at its side wall, said locking post being movable along the guide surfaces of the main body while being changed in its position within the longitudinal slits during an either directional rotation of the roller frame relative to the main body; and a spring held on the roller frame at one end thereof and on the main body at the other end thereof, and normally applying elastic force to the roller frame.

In this invention, a stopper is formed on the main body for preventing an excessive rotation of the roller frame.

In addition, the guide surfaces has a shoulder profile capable of stably holding the locking post in cooperation with the elastic force of the spring at a time the holding roller of the roller frame comes into compression contact with the rubber roller of the main body.

In the preferred embodiment of this invention, the spring is held by the locking post of the roller frame at one end thereof and by a spring holding shaft at the other end thereof, the spring holding shaft being provided around the bottom of the paper roll seat opening.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
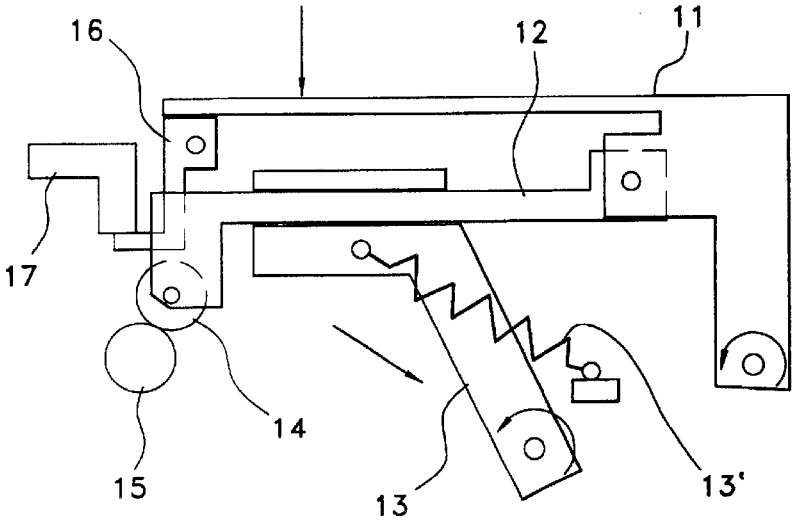
FIG. 1 (CONVENTIONAL ART)
FIG. 1 is a view, showing the construction of a conventional clamshell device for printers.

Reference now should be made to the drawings, in which the same reference numerals are used throughout the different drawings to designate the same or similar components.

Figure 2:
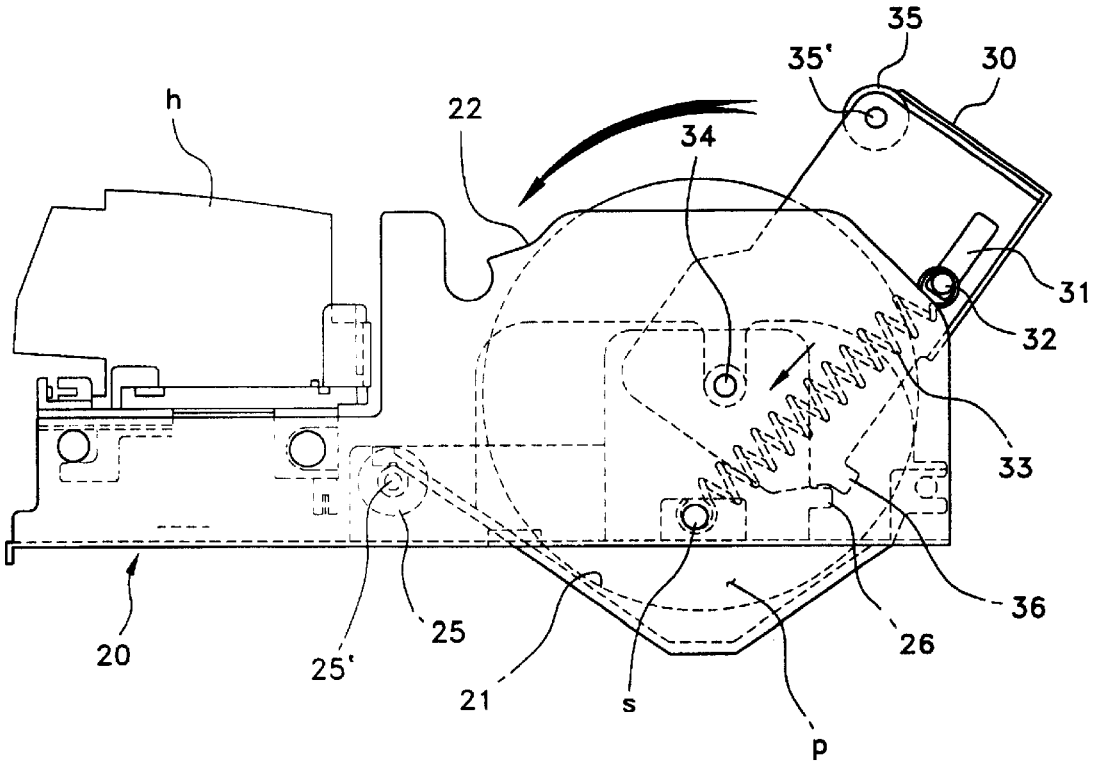
FIG. 2 is a view, showing the construction of a clamshell device for printers in accordance with the preferred embodiment of the present invention.
Figure 3:
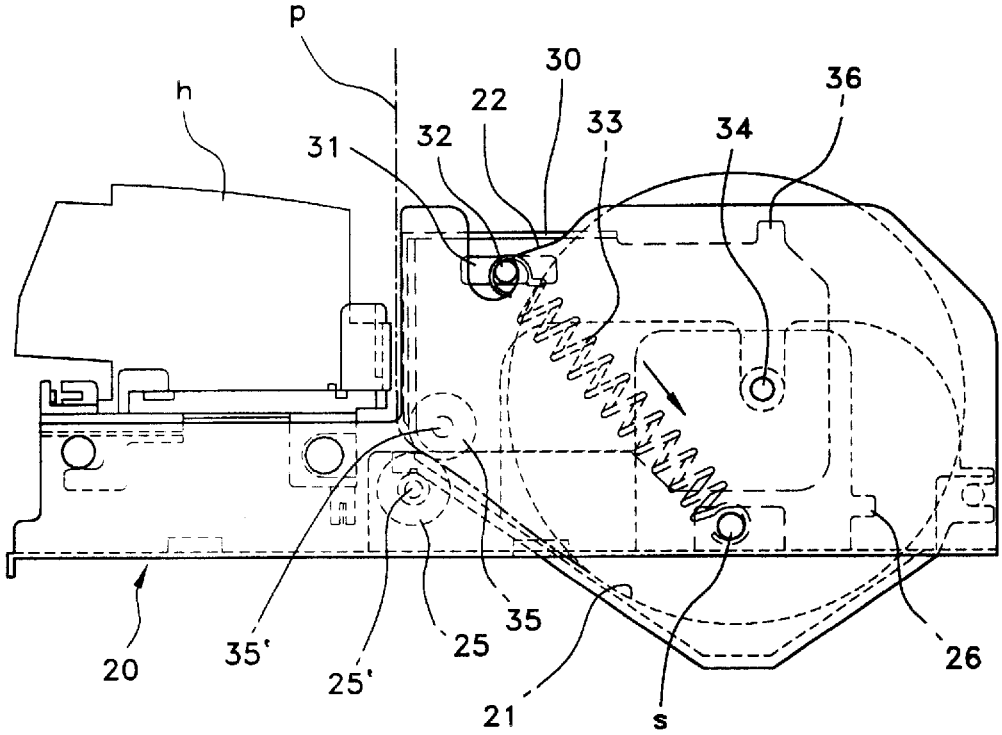
FIG. 3 is a view, showing an operation of the clamshell device of FIG. 2.
Figure 4:
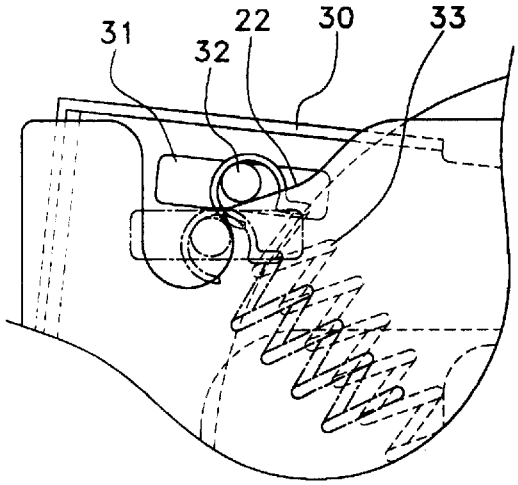
FIG. 4 is a view, showing an operation of the locking structure for locking the roller frame to the main body in the clamshell device of the present invention.

FIG. 2 is a view, showing the construction of a clamshell device for printers in accordance with the preferred embodiment of the present invention. FIG. 3 is a view, showing an operation of the clamshell device of FIG. 2. FIG. 4 is a view, showing an operation of the locking structure for locking the roller frame to the main body in the clamshell device of the present invention.

As shown in the drawings, the clamshell device of this invention comprises a main body 20, a roller frame 30, and a elastic member. The main body 20 includes a paper roll seat opening 21 used for installing a paper roll "P" therein, while the roller frame 30 is hinged the main body 20, and selectively closes the paper roll seat opening 21. The elastic member normally applies elastic force to the roller frame 30 so as to allow the frame 30 to be elastically rotatable around its hinge shaft.

The main body 20 have the paper roll seat opening 21, which is opened at its top as shown in the drawings and has a predetermined size. A rubber roller 25 is rotatably mounted to the end of the main body 20 around the paper roll seat opening 21.

Paper is unwound from the paper roll "P", installed in the paper roll seat opening 21, and is fed to the printer head "h", provided at an end of the main body 20, by the rotating force of the rubber roller 25. Thus, a desired printing process is performed.

The rubber roller 25 is a cylindrical roller made of soft rubber, with a first roller shaft 25' made of a rigid metal and set along the central axis of the rubber roller 25. Both ends of the first roller shaft 25' are rotatably set in the main body 20.

One end of the first roller shaft 25' is connected to a drive motor (not shown), and so the rubber roller 25 is rotatable along with the first roller shaft 25' by the rotating force of the drive motor.

The above rubber roller 25 comes into compression contact with a holding roller 35 of the roller frame 30 as will be described in detail herein below, with the paper unwound from the paper roll "p" passing through the nip of the two rollers 25 and 35. In such a case, the two rollers 25 and 35 are rotated together by the rotating force of the drive motor, and feed the paper to the printer head "h".

The main body 20 is provided with guide surfaces 22 at the upper edges of its vertical sidewalls defining the paper roll seat opening 21 as shown in the drawings. The guide surfaces 22 is inclined downward at an angle of inclination in a direction toward the printer head "h".

The roller frame 30 is hinged to the main body 20 by a hinge shaft 34, and closes the open top of the paper roll seat opening 21 as described above. This roller frame 30 includes a locking post 32, which is movable along the guide surfaces 22 of the main body 20 and a holding roller 35, which selectively comes into compression contact with the rubber roller 25 of the main body 20 so as to feed the paper to the printer head "h" during a printing process.

The above locking post 32 is a cylindrical pin having a predetermined length, and is installed in the roller frame 30 such that it is in parallel to the rubber roller 25 of the main body 20.

In such a case, each end of the locking post 32 is movably set within the longitudinal slits 31 formed on the sidewalls of the roller frame 30. Of course the longitudinal slits 31 has a predetermined length so as to limit the movement of the locking post 32 within the slits 31.

When the roller frame 30 is rotated counterclockwise around its hinge shaft 34 as shown by the arrow of FIG. 2 to close the open top of the paper roll seat opening 21, the locking post 32 are moved toward the printer head "h" along the guide surfaces 22 of the main body 20. During the movement of the locking post 32 along the guide surfaces 22, the position of the locking post 32 within the longitudinal slits 31 is changed.

The holding roller 35 is a cylindrical roller made of soft rubber, with a second roller shaft 35' made of a rigid metal and set along the central axis of the holding roller 35. Each ends of the second roller shaft 35' is rotatably set in the sidewalls of the roller frame 30.

The above holding roller 35 selectively comes into compression contact with the rubber roller 25 of the main body 20 so as to feed the paper unwound from the paper roll "p" to the printer head "h" while compressing the paper at the nip of the two rollers 25 and 35.

In the clamshell device of this invention, the elastic member normally applies elastic force to the roller frame 30 during a rotating action of the frame 30 relative to the main body 20, thus allowing the frame 30 to be elastically and more easily rotatable around its hinge shaft 34. The above elastic member also allows the locking post 32 to be elastically locked to the main body 20 after moving along the guide surfaces 22. In the preferred embodiment of the present invention, a conventional compression coil spring 33 is used as the elastic member.

The above spring 33 is held by the locking post 32 at the one end thereof and by a spring holding shaft "s" at the other end thereof. The spring holding shaft "s" is provided at a predetermined position around the bottom of the paper roll seat opening 21. The compression coil spring 33 normally pulls the locking post 32 of the roller frame 30 in a direction toward the main body 20.

Due to the elastic force of the compression coil spring 33, the locking post 32 is normally pulled toward the main body 20. The locking post 32 are thus normally placed within the longitudinal slits 31 at the closest to the main body 20.

Since the compression coil spring 33 normally pulls the locking post 32 of the roller frame 30 in the direction toward the main body 20 as described above, the spring 33 forms either directional moment on the roller frame 30 during a rotating action of the frame 30. The roller frame 30 is thus quickly rotated in a desired direction so as to open or close the paper roll seat opening 21 during its rotating action.

A stopper 26 is provided at a predetermined position of the main body 20, and comes into contact with the roller frame 30 so as to prevent an excessive rotation of the frame 30 during an opening action of the frame 30. That is, the stopper 26 limits a rotation angle of the roller frame 30 when the frame 30 is opened. Of course, it should be understood that it is possible to freely change the shape and position of the stopper when the stopper effectively performs its desired operational function of limiting the rotation angle of the roller frame 30. In the preferred embodiment of the present invention, another stopper 36 is formed on the roller frame 30 at a position corresponding to the stopper 26 so as to allow the stopper 26 to reliably limit the rotation angle of the roller frame 30.

The clamshell device of this invention having the above-mentioned construction is operated as follows.

When the roller frame 30 of the clamshell device is closed as shown in FIG. 3, the roller frame 30 is rotated counterclockwise around the hinge shaft 34.

In such a counterclockwise rotation of the roller frame 30, the holding roller 35 of the roller frame 30 is brought into compression contact with the rubber roller 25 of the main body 20.

Therefore, the paper, unwound from the paper roll "p" and fed into the nip of the rollers 25 and 35, is tensioned by the constant force of the two rollers 25 and 35 acting on the nip to draw the paper from the roll "p". After the two rollers 25 and 35 are brought into compression contact with each other with the paper positioned at the nip of the two rollers 25 and 35, the rubber roller 25 is rotated along with the holding roller 35 by the motor (not shown), thus feeding the paper to the printer head "h" while maintaining desired tension of the paper.

When the roller frame 30 is closed as described above, the locking post 32 of the frame 30 moves along the guide surfaces 22 of the main body 20 in a direction toward the printer head "h". In such a case, The guide surfaces 22 has a locking shoulder with a profile capable of stably holding an associated end of the locking post 32 in cooperation with the elastic force of the compression coil spring 33 as best seen in FIG. 4. Due to such a specifically designed shape of the guide surfaces 22, the locking post 32 is stably locked to the guide surfaces 22 at a time the holding roller 35 comes into compression contact with the rubber roller 25 to make the roller frame 30 completely closed.

That is, when the roller frame 30 is rotated to a closed position, the locking post 32 is moved to the left under the guide of the guide surfaces 22 of the main body 20 as shown in FIG. 3 while being pulled by the counterclockwise moment generated by the compression coil spring 33.

Therefore, the locking post 32 slides along the guide surfaces 22 of the main body 20 while being moved to the left in FIG. 3, thus allowing the roller frame 30 to be more quickly rotated counterclockwise in the drawing.

The guide surface 22 has an inclined section that slopes downward in the leftward direction of the drawings. During a rotating action of the roller frame 30 to accomplish the closed position, the locking post 32 of the roller frame 30 smoothly slides along the inclined section of the guide surfaces 22, and so it is possible to smoothly close the roller frame 30 without applying any excessive impact to the main body 20.

On the other hand, when the roller frame 30 of the clamshell device is opened, the roller frame 30 is rotated clockwise around ts hinge shaft 34.

In such a clockwise rotation of the roller frame 30, the holding roller 35 of the roller frame 30 is primarily released from the compression contact with the rubber roller 25 of the main body 20. The clockwise rotation of the roller frame 30 is continued to fully open the frame 30 until the stopper of the main body 20 stops the rotation of the frame 30.

When the roller frame 30 is rotated clockwise in the drawings, the locking post 32 of the frame 30 moves to the right along the guide surfaces 22. In such a case, the locking post 32 is pulled by the clockwise moment generated by the compression coil spring 33.

When the roller frame 30 reaches a predetermined opened position having an open angle during such a clockwise rotation, the roller frame 30 is more quickly rotated clockwise due to the moment of the compression coil spring 33, thus accomplishing its fully opened position.

As described above, the present invention provides a clamshell device for printers. This clamshell device has a simple construction with a reduced number of parts, thus being easily fabricated through a simple process capable of improving work efficiency and productivity while manufacturing such clamshell devices in commercial quantities.

In addition, the clamshell device of this invention reduces the size of its parts, and so it is preferably improved in its design flexibility, in addition to being preferably usable in a variety of compact printers.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A clamshell device for printers, comprising:

a main body including two side walls, a paper roll seat opening used for installing a paper roll therein, with a guide surface formed at an upper edge of each sidewall defining the paper roll seat opening, said guide surface being inclined at an angle of inclination;

a roller frame hinged to the main body and closing the paper roll seat opening, said roller frame having a holding roller coming into compression contact with a rubber roller of the main body so as to give compression force to paper passing through the nip of the rubber and holding rollers;

a locking post movably set within two longitudinal slits of the roller frame at its side wall, said locking post being movable along the guide surfaces of the main body while being changed in its position within the longitudinal slits during rotation in either direction of the roller frame relative to the main body;

and a spring held on said roller frame at one end thereof and on the main body at the other end thereof, and normally applying elastic force to the roller frame.

2. The clamshell device according to claim 1, wherein a stopper is formed on the main body for preventing an excessive rotation of said roller frame.

3. The clamshell device according to claim 1, wherein said guide surfaces has a bent portion with a profile capable of stably holding the locking post in cooperation with the elastic force of the spring at a time the holding roller of the roller frame comes into compression contact with the rubber roller of the main body.

4. The clamshell device according to claim 1, wherein said spring is held by the locking post of the roller frame at the one end thereof and by a spring holding shaft at the other end thereof, said spring holding shaft being provided around a bottom of said paper roll seat opening.

* * * * *